US006770012B2

(12) United States Patent
Kuo

(10) Patent No.: US 6,770,012 B2
(45) Date of Patent: Aug. 3, 2004

(54) SELF-GENERATING WRIST BALL

(76) Inventor: Hsiu-Min Kuo, No. 38, Ming Hsing Street, Kweishan Hsiang, Taoyuan Hsien (TW)

( * ) Notice: Subject to any disclaimer, the term of this patent is extended or adjusted under 35 U.S.C. 154(b) by 137 days.

(21) Appl. No.: 10/235,746

(22) Filed: Sep. 6, 2002

(65) Prior Publication Data

US 2004/0048720 A1 Mar. 11, 2004

(51) Int. Cl.[7] ..... A63B 23/14; A63B 21/22; A63B 43/06; A63H 1/24

(52) U.S. Cl. ..... 482/44; 482/110; 482/45; 446/235; 446/242; 446/248

(58) Field of Search ..... 482/2, 44, 45, 482/49, 110; 446/133, 233, 235, 242, 248

(56) References Cited

U.S. PATENT DOCUMENTS 942,952 A * 12/1909 Wrather ..... 446/235
2,666,276 A * 1/1954 Huff ..... 446/235
4,150,580 A * 4/1979 Silkebakken et al. ..... 74/5 R
5,150,625 A * 9/1992 Mishler ..... 74/5 R
5,353,655 A * 10/1994 Mishler ..... 74/5 R
5,800,311 A * 9/1998 Chuang ..... 482/44
6,186,914 B1 * 2/2001 Lin ..... 473/594
6,623,405 B2 * 9/2003 Chuang et al. ..... 482/44
6,629,908 B2 * 10/2003 Hamady ..... 482/45

* cited by examiner

*Primary Examiner*—Nicholas D. Lucchesi
*Assistant Examiner*—Victor Hwang
(74) *Attorney, Agent, or Firm*—Rosenberg, Klein & Lee

(57) ABSTRACT

The present invention relates to a self-generating wrist ball which includes a ball-shaped housing, a revolution ring, a flywheel and a generating and lighting mini-module. The ball-shaped housing has a plurality of protruding arched pieces to enhance the light-concentrating effect and to increase the stability when the fingers hold the wrist ball. The generating and lighting mini-module includes at least two rotor aggregates within flywheel and at least two stator aggregates corresponding to said rotor aggregates being fixed on the revolution ring. The wrist ball is self-generating in operational state by means of the impulse excitation created at the rotational moment of the wrist ball. In addition, the effect of magnetic field line can be enhanced by means of magnets and magnetic metal plates of the rotor aggregates and the stator aggregates. Furthermore, the same magnetic poles of both magnets are arranged in opposite way to prevent the flywheel from interference in rotation.

1 Claim, 9 Drawing Sheets

SELF-GENERATING WRIST BALL

BACKGROUND OF THE INVENTION

1. Field of the Invention

The present invention relates to a self-generating wrist ball, and more particularly, to a roller ball which produces its own required energy created by impulse excitation at the rotation moment.

2. Description of the Prior Art

The wrist ball is a body-building apparatus with exercise fun. Its configuration, as shown in FIGS. 1(A), 1(B) and 1(C), includes a ball-shaped housing 1, a revolution ring 2 and a flywheel 3. The ball-shaped housing 1 consists of a top housing 11 and a bottom housing 12 both of which are connected by radio frequency as one hollow body. The top housing 11 is provided with a circular opening 111 at the top thereof. The revolution ring 2 is disposed on support rim 121 on the inside of the top of the bottom housing 12 and rotatable thereon. Two connecting holes 21 are arranged at both sides of the support rim 121. The flywheel 3 has a central shaft 31 pivotably connected to the connecting holes 21 of the revolution ring 2 so as to be received within the top and bottom housings 11, 12. An annular ridge 32 is disposed at the center of the surface of the flywheel 3 and provided with a through hole 321.

Again, referring to FIGS. 2(A), 2(B) and 2(C), a string 4 with one end inserted into the through hole 321 is then placed around the annular ridge 32. Thereafter, when the string 4 is pulled out, the flywheel 3 rotates about the central shaft 31 within the revolution ring 2.

As shown in FIG. 3, the ball-shaped housing 1 is held within the palm of the hand for rotation thereof. The flywheel 3 together with the revolution ring 2 orbits the ball-shaped housing 1 in addition to rotating along the annular ridge 32. In other words, the flywheel 3 produces the effect of "rotation and revolution" within the ball-shaped housing 1. The forces of these two rotations in two different directions create an inertia torsion moment. When the wrist controls the movement of the ball body, the ball body will create a torsional moment against the wrist. It's very marvelous. The wrist ball is not only supposed to exercise/strengthen wrist muscles, but also have fun like playing toys.

After the above-mentioned wrist ball has been developed, it has been over ten years that it was not changed and improved, thereby losing attraction degree by degree. Therefore, someone has tried to make the housing transparent while the flywheel 3 is provided with light fitting (e.g. LEDs). In use, the blazing rotational light is produced. However, the light fitting needs batteries to supply power. However, there are two drawbacks in installing batteries within the flywheel 3:

1. The small battery is easily used up after few hours, thereby producing no light more. To ensure the safety, the top and bottom housings 11, 12 are welded by radio frequency before leaving the factory so that the wrist ball can't be opened to put a new battery therein. Thus, the lighting duration is limited, thereby leading to discontent of the consumers because they have the feeling of being cheated.
2. Batteries cause pollution to environment. Therefore, an amount of pollution tax will be levied in some countries before installation of batteries into the wrist ball. As a result, it's also a factor that lighting wrist ball can't be spread.

It has been also tried to install a generating apparatus within the wrist ball. However, it fails because of its limited space. Thus, it's not easy to solve the problem with generating electricity. Even, it's more difficult for the wrist ball to continuously furnish the light fitting with electricity and to produce proper luminance. Consequently, the commercially available wrist ball has no successful self-generating example.

SUMMARY OF THE INVENTION

It is a primary object of the present invention to provide a self-generating wrist ball which is so designed as if a mini-generator is provided inside by means of impulse excitation created during the moment of the rotation of the wrist ball. Therefore, a self-generating effect during operation is created.

It is another object of the present invention to provide a self-generating wrist ball through which the problems with environmental protection caused by discarded batteries can be avoided.

It is a further object of the present invention to provide a self-generating wrist ball which continues to effectively produce electricity. Moreover, the light can be effectively concentrated to emit blazing beams. Besides, the generating mini-module won't affect the operation of the wrist ball inside.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1A:
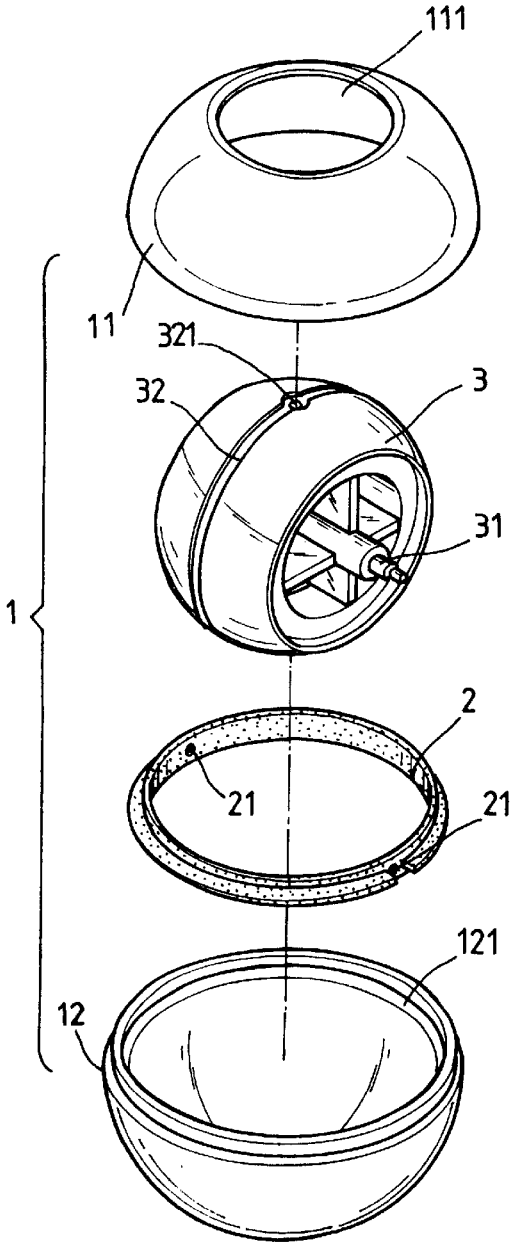
FIG.1(A) PRIOR ART
FIG. 1(A) is a perspective exploded view of a conventional wrist ball.
Figure 1B:
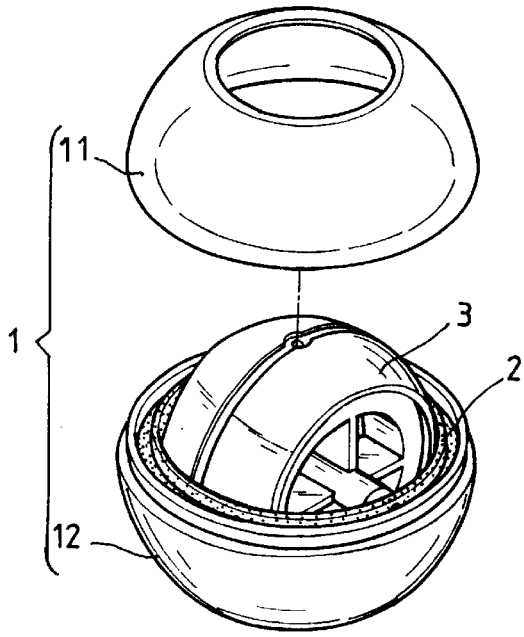
FIG.1(B) PRIOR ART
FIG. 1(B) is a perspective partially-exploded view of the conventional wrist ball.
Figure 1C:
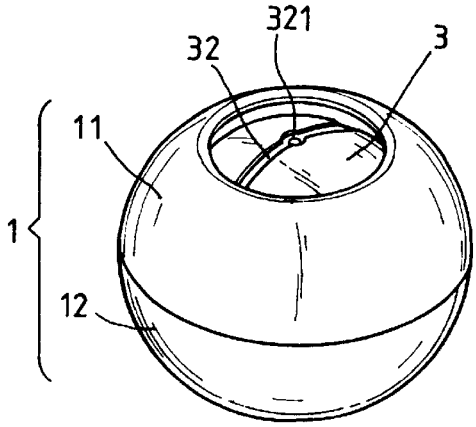
FIG.1(C) PRIOR ART
FIG. 1(C) is a perspective view of the conventional wrist ball.
Figure 2A:
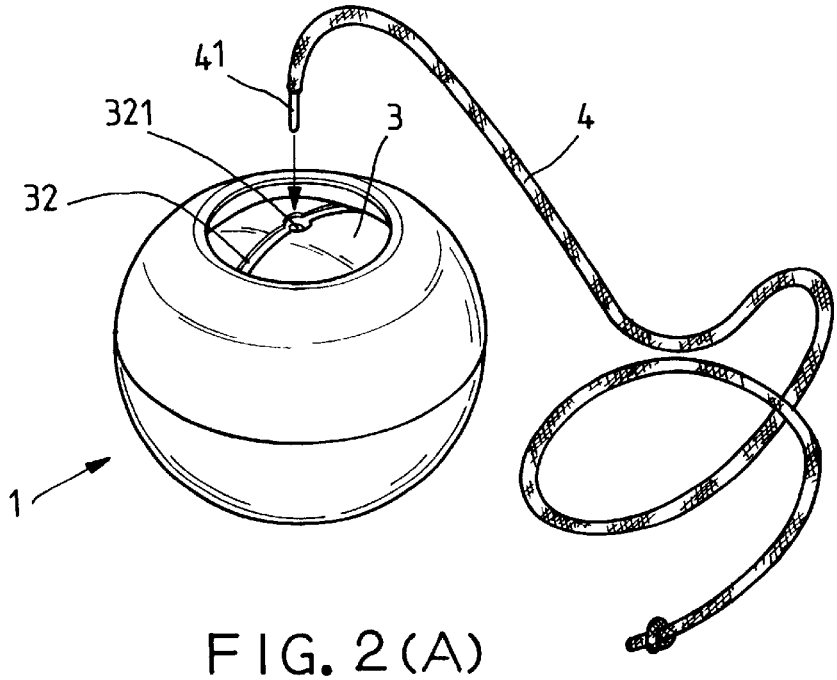
FIG. 2(A) PRIOR ART
FIGS. 2(A), 2(B) and 2(C) are perspective views of the conventional wrist ball showing the operation thereof.
Figure 2B:
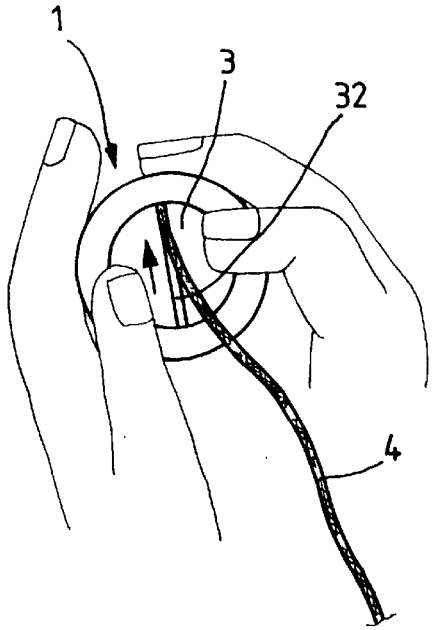
FIG.2(B) PRIOR ART
Figure 2C:
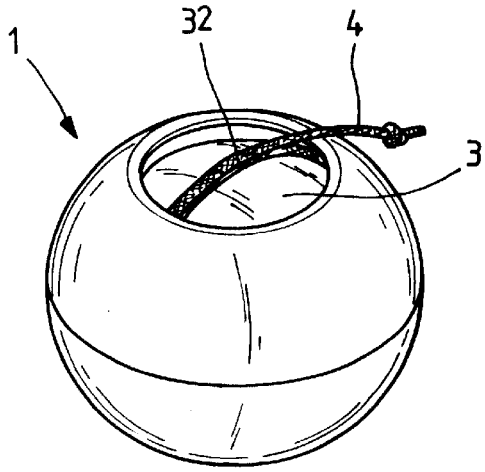
FIG. 2(C) PRIOR ART
Figure 3:
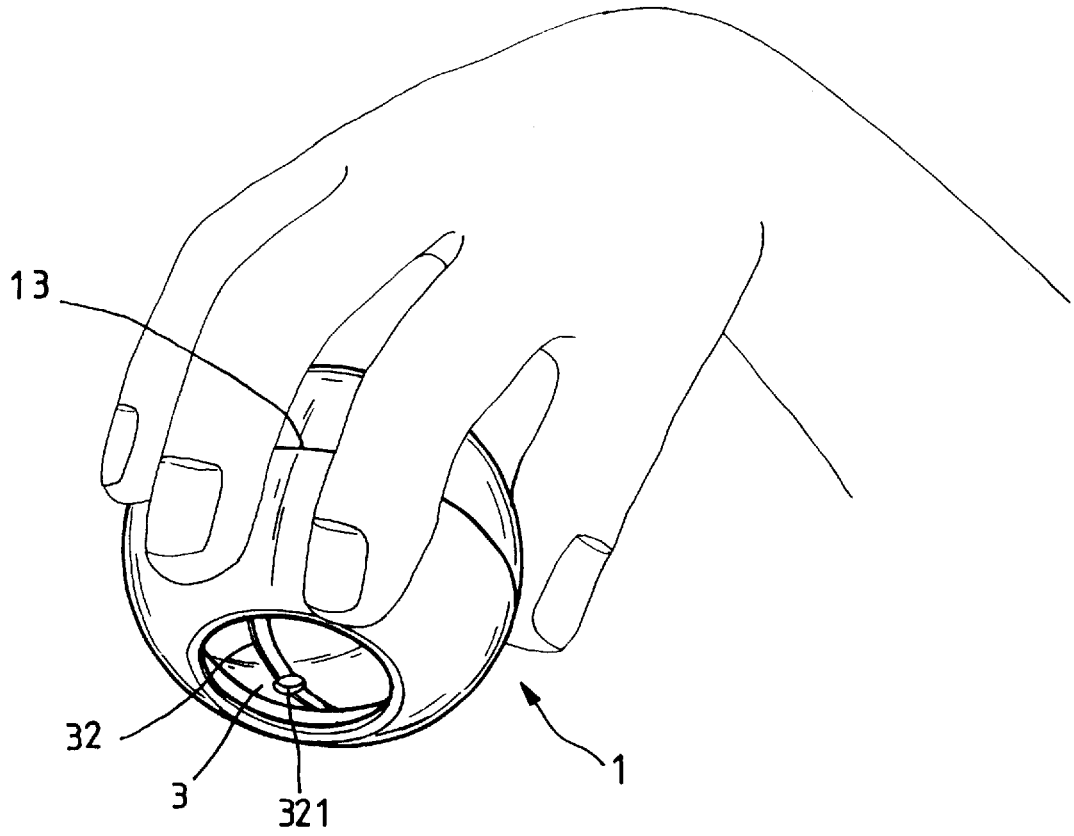
FIG.3 PRIOR ART
FIG. 3 is a perspective view of the conventional wrist ball which is held by a hand.
Figure 4:
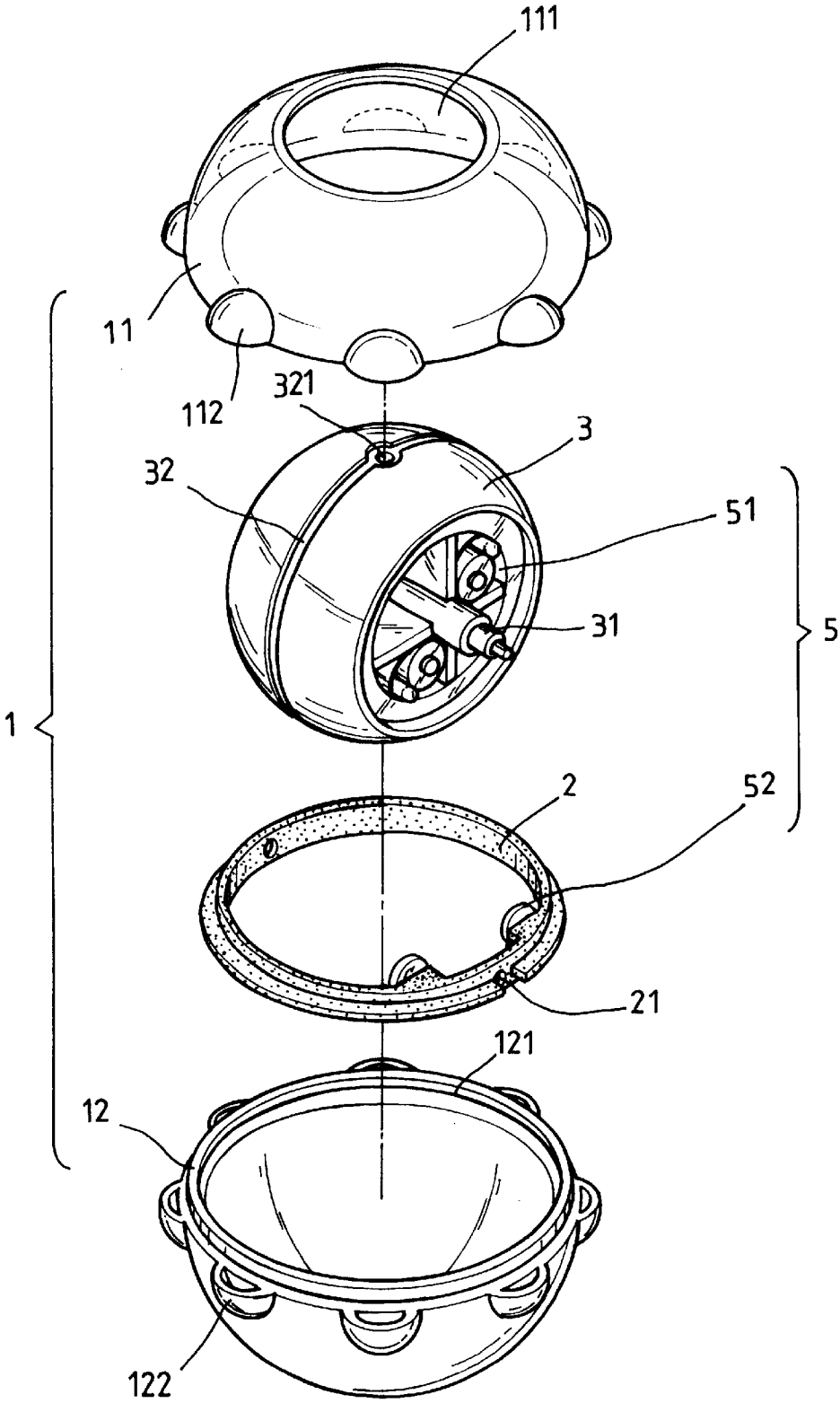
FIG. 4 is a perspective exploded view of the present invention.
Figure 5:
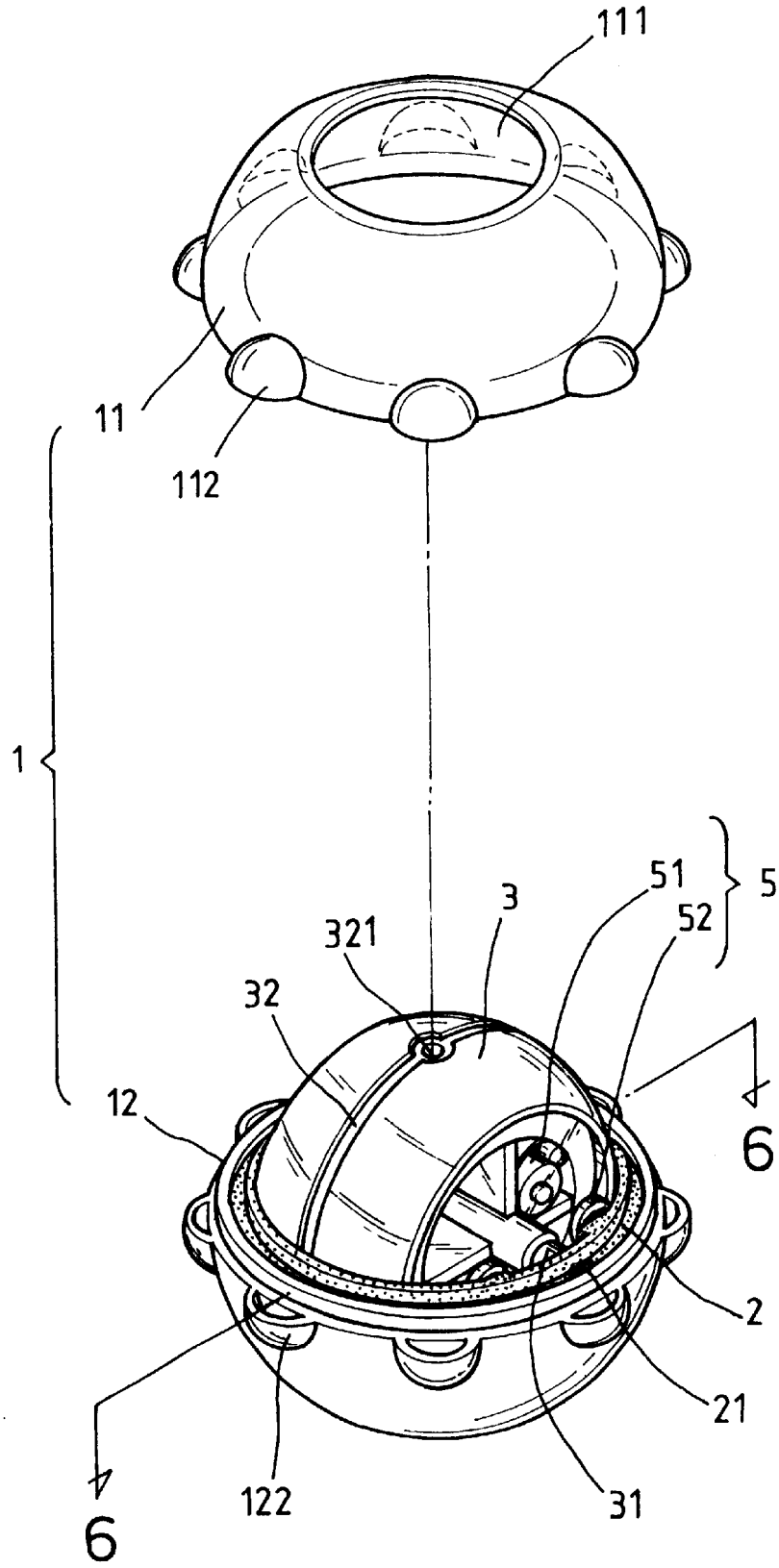
FIG. 5 is a perspective partially-exploded view of the present invention.
Figure 6:
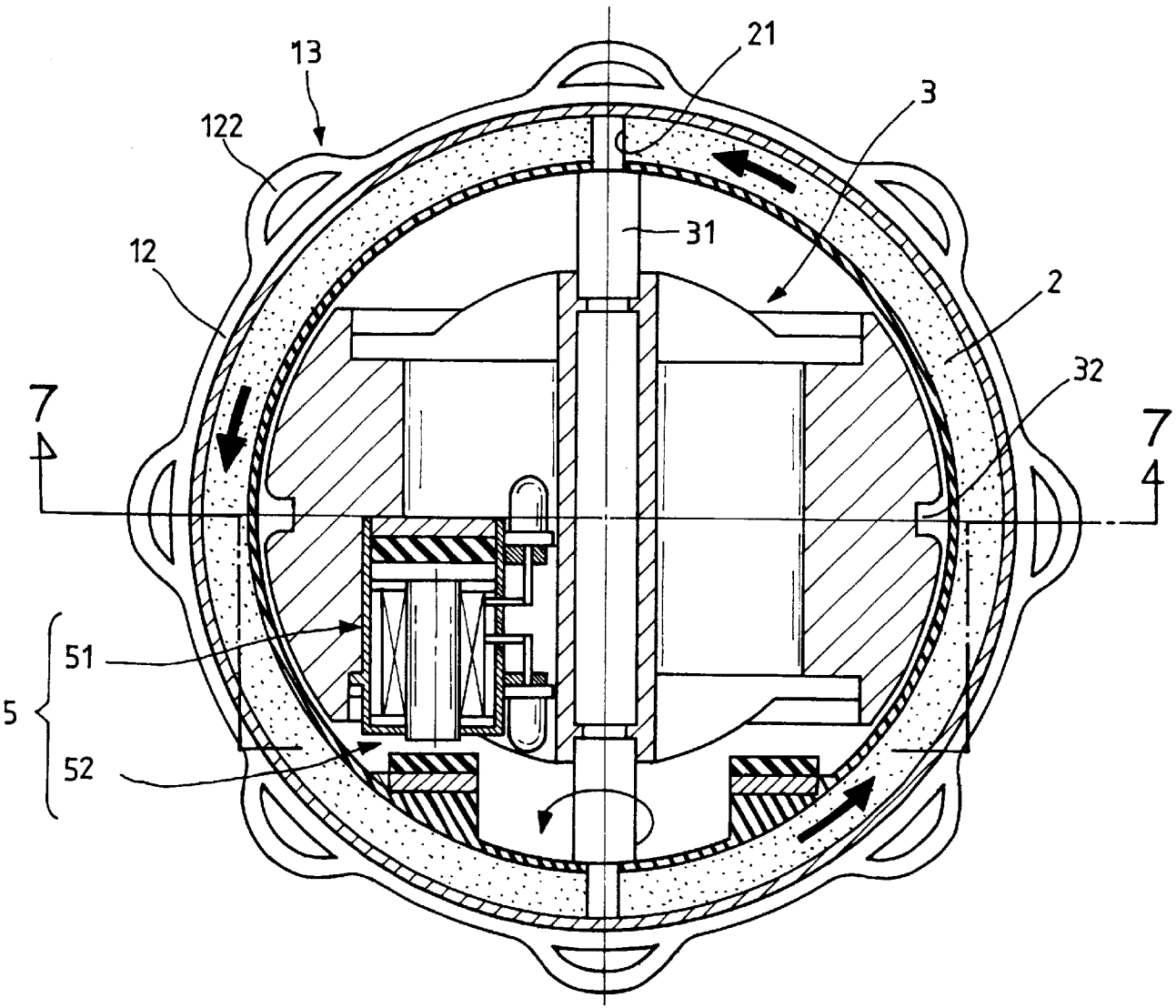
FIG. 6 is a sectional view taken along the line of 6—6 in FIG. 5.

First of all, referring to FIGS. 4 through 8, the self-generating wrist ball in accordance with the present invention includes a ball-shaped housing 1, a revolution ring 2 and a flywheel 3. The ball-shaped housing 1 consists of a top housing 11 and a bottom housing 12 both of which are connected by radio frequency as one hollow body. The top housing 11 is provided with a circular opening 111 at the top thereof. The revolution ring 2 is disposed at the support rim 121 on the inside of the top of the bottom housing 12 and is rotatable thereon. Two connecting holes 21 are arranged at both sides of the support rim 121. The flywheel 3 has a central shaft 31 pivotably connected to the connecting holes 21 of the revolution ring 2 so as to be received within the top and bottom housings 11, 12. An annular ridge 32 is disposed at the center of the surface of the flywheel 3 and provided with a through hole 321.

A plurality of protruding arched members 112, 122 are arranged on the connection rim of the top and bottom housings 11, 12, thereby forming a plurality of protruding arched pieces 13 at regular intervals on the connection rim when both top and bottom housings 11, 12 are combined as the ball-shaped housing 1.

A generating and lighting mini-module 5 having at least two rotor aggregate aggregates 51 and at least two stator aggregates 52 is arranged on the revolution ring 2 and the central shaft 31 of the flywheel 3. The rotor aggregates 51 are disposed opposite each other on the inner side of the flywheel 3 to make 360° rotation with the flywheel 3. The stator aggregates 52 corresponding to the rotor aggregates 51 are fixed on the inner side of the revolution ring 2. Accordingly, the rotor aggregates 51 are tangent to the stator aggregates 52 when the rotor aggregates 51 is rotated.

The rotor aggregate 51 includes a coil 512 and a T-shaped iron core 513 within a modularized housing 511. A first magnet 514 is provided at the bottom of the T-shaped iron core 513. A first magnetic metal plate 515 is fitted to the bottom of the first magnet 514. Besides, at least one light-emitting diode 516 fastened on the modularized housing 511 is connected to the coil 512, thereby forming a modularization type.

The stator aggregate 52 opposite to the T-shaped iron core 51 includes a second magnet 521. A second magnetic metal plate 522 is disposed at the outer side of the second magnet 521.

Moreover, the same magnetic poles of the first magnet 514 and the second magnet 521 are arranged in opposite way (N<=>N or S<=>S).

Figure 7:
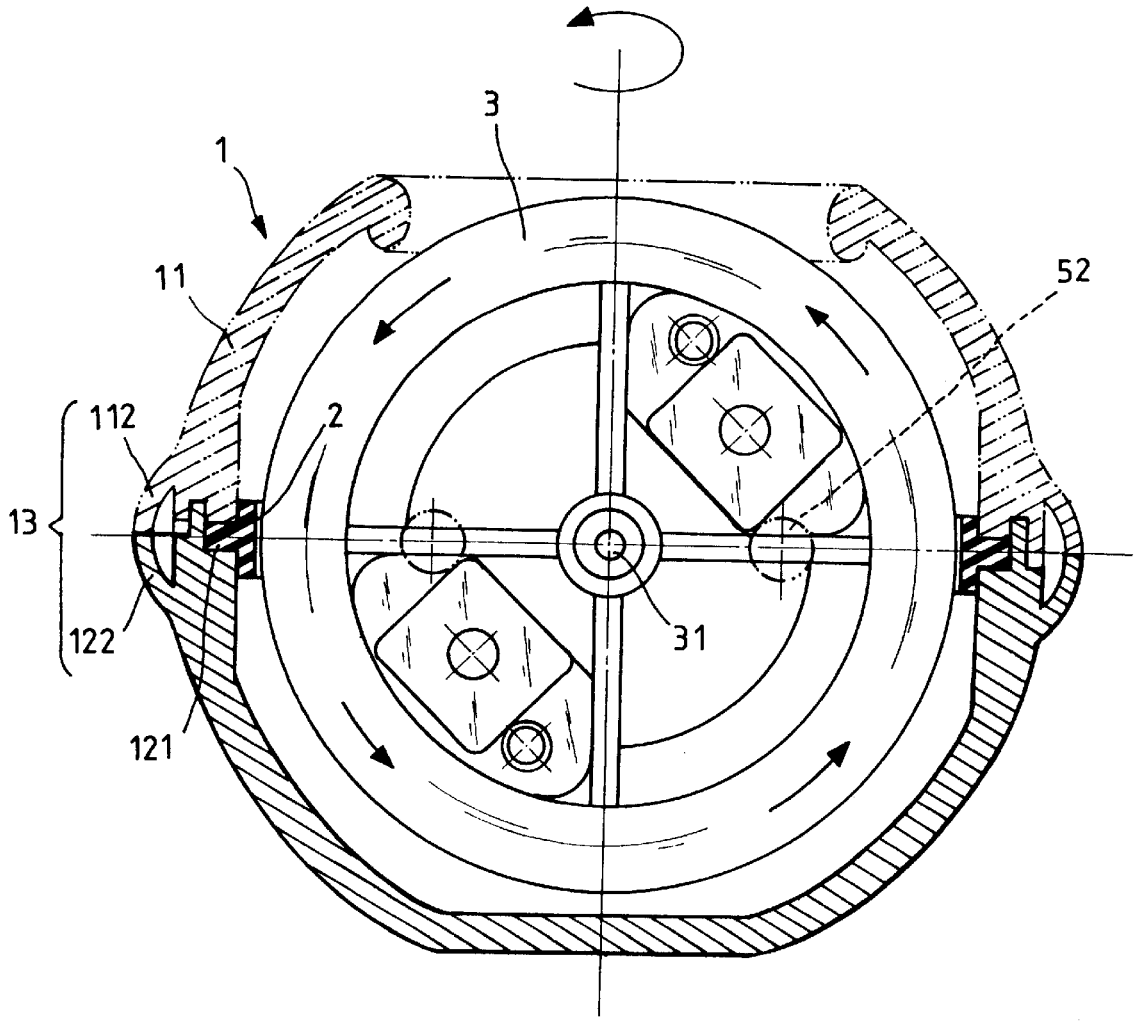
FIG. 7 is a sectional view taken along the line of 7—7 in FIG. 6.
Figure 9:
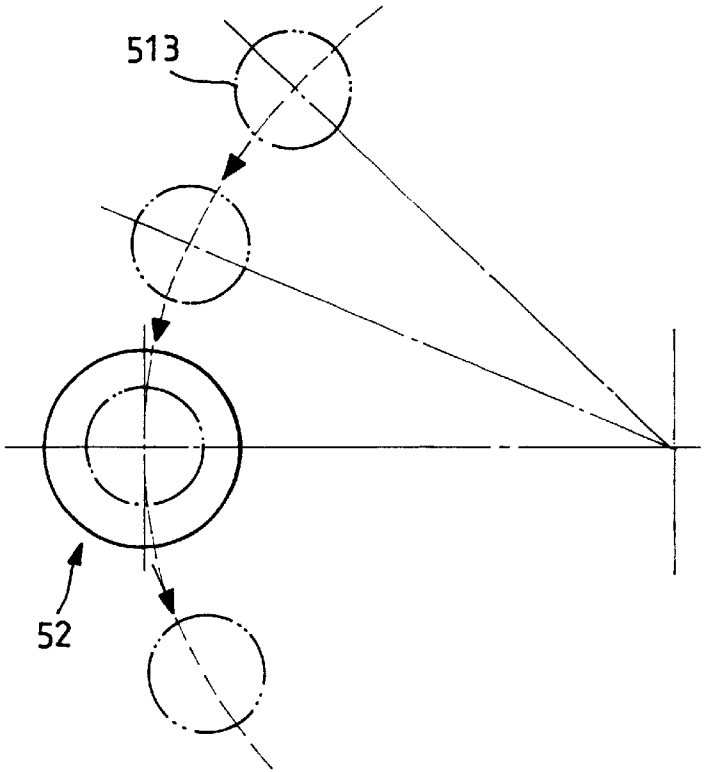
FIG. 9 is a schematic drawing of the generating and lighting mini-modules of the present invention showing the operation thereof.
Figure 8:
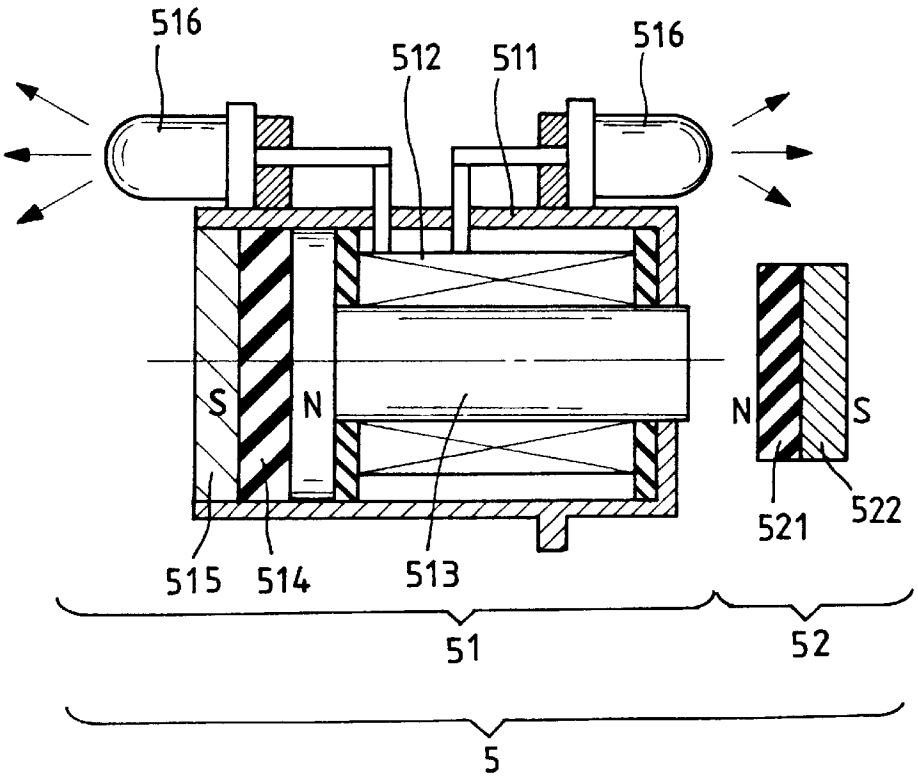
FIG. 8 is a schematic drawing of the generating and lighting mini-modules of the present invention.
Figure 10:
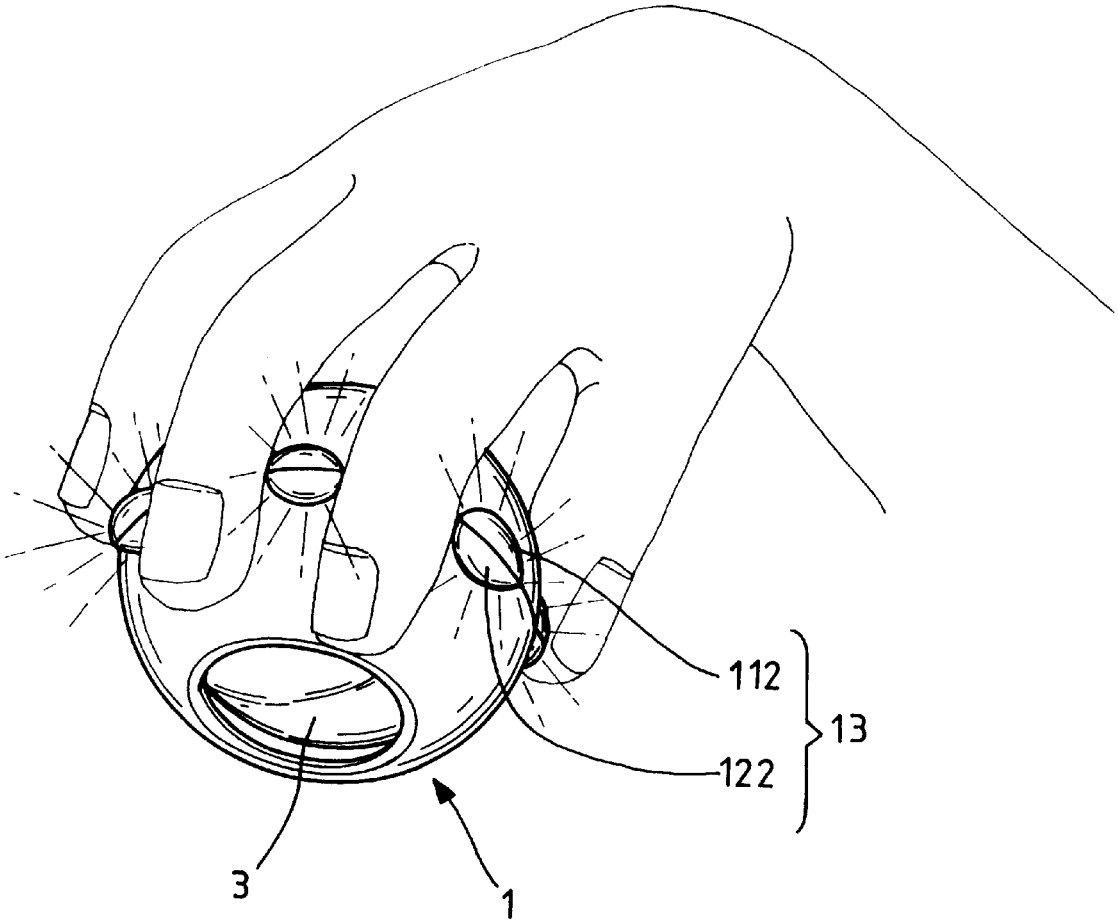
FIG. 10 is a perspective view of the present invention which is held by a hand.

Based upon the above-mentioned technique, the present invention has the following effects required for more descriptions:

1. The generating and lighting mini-module 5 of the present invention is received within the wrist ball without increasing its volume and affecting its operation. Besides, the disadvantages of using batteries can be avoided for environmental protection.
2. The rotor aggregate 51 together with the light-emitting diode 516 has been modularized to facilitate their installation within the flywheel 3. Therefore, the assembly is very convenient. When the T-shaped iron core 513 of the rotor aggregate 51 is tangent to the stator aggregate 52, as shown in FIG. 9, an impulse excitation will be created at that moment such that the coil 512 produces electric current required by the light-emitting diodes 516. Besides, the first and second magnets 514, 521 are connected to the first and second magnetic metal plates 515, 522, respectively, so that the effect of magnetic field line can be enhanced to have a greater magnetic flux. Accordingly, one generating and lighting mini-module 5 is enough for use of front and rear light-emitting diodes 516.
3. The same electric poles of the first and second magnets 514, 521, as shown in FIG. 8, are arranged in opposite way such that the rotor aggregates 51 and the stator aggregates 52 won't be attracted to each other. Accordingly, the rotation of the flywheel 3 won't be affected.
4. As shown in FIGS. 7 and 10, the protruding arched pieces 13 on the connection rim of the top and bottom housings 11, 12 have the light-concentrating effect such that the beams produced by the light-emitting diodes 516 and passing through the protruding arched pieces 13 are very bright and blazing. In addition, the protruding arched pieces 13 can be used to receive the fingers in place so as to increase the stability in holding the wrist ball.

Many changes and modifications in the above-described embodiment of the invention can, of course, be carried out without departing from the scope thereof.

Accordingly, to promote the progress in science and the useful arts, the invention is disclosed and is intended to be limited only by the scope of the appended claim.

What is claimed is:

1. A self-generating wrist ball comprising:

a ball-shaped housing having a top housing and a bottom housing both of which are connected by radio frequency as one hollow body, said top housing being provided with a circular opening at the top thereof;

a revolution ring disposed at support rim on the inside of the top of said bottom housing and rotatable thereon, two connecting holes being arranged at both sides of said support rim;

a flywheel having a central shaft pivotably connected to said connecting holes of said revolution ring so as to be received within said top and bottom housings, an annular ridge being disposed at the center of the surface of said flywheel and provided with a through hole;

wherein a plurality of protruding arched members are arranged on the connection rim of said top and bottom housings, thereby forming a plurality of protruding arched pieces at regular intervals when both top and bottom housings are combined as said ball-shaped housing, and wherein a generating and lighting mini-module having at least two rotor aggregate aggregates and at least two stator aggregates is arranged on said revolution ring and said central shaft of said flywheel, and wherein said rotor aggregates are disposed opposite each other on the inner side of said flywheel to make 360° rotation with said flywheel, and said stator aggregates corresponding to said rotor aggregates are fixed on the inner side of said revolution ring; accordingly, said rotor aggregates are tangent to said stator aggregates when said rotor aggregates is rotated; and wherein said rotor aggregates includes a coil and a T-shaped iron core inside a modularized housing, and a first magnet is provided at the bottom of said T-shaped iron core, and a first magnetic metal plate is fitted to the bottom of said first magnet, and at least one light-emitting diode fastened on said modularized housing is connected to the coil, thereby forming a modularization type; and wherein said stator aggregate opposite to said T-shaped iron core includes a second magnet, and a second magnetic metal plate is disposed at the outer side of said second magnet.

* * * * *